US006154019A

United States Patent [19]

Valdemarsson et al.

[11] Patent Number: 6,154,019

[45] Date of Patent: Nov. 28, 2000

[54] CONTROLLABLE INDUCTOR

[75] Inventors: Stefan Valdemarsson; Lars Liljestrand, both of Västerås, Sweden

[73] Assignee: ABB AB, Vasteras, Sweden

[21] Appl. No.: 09/180,581

[22] PCT Filed: May 16, 1997

[86] PCT No.: PCT/SE97/00802

§ 371 Date: Nov. 12, 1998

§ 102(e) Date: Nov. 12, 1998

[87] PCT Pub. No.: WO97/44795

PCT Pub. Date: Nov. 27, 1997

[30] Foreign Application Priority Data

May 23, 1996 [SE] Sweden ..... 9601948

[51] Int. Cl.[7] ..... H01F 29/14; H01F 27/08

[52] U.S. Cl. ..... 323/361; 336/55; 336/59; 336/60

[58] Field of Search ..... 323/361; 336/55, 336/59, 60, 155, 207

[56] References Cited

U.S. PATENT DOCUMENTS

| | | | |
|---|---|---|---|
| 4,162,428 | 7/1979 | Elms | 315/284 |
| 4,350,934 | 9/1982 | Spreadbury | 315/282 |
| 4,450,588 | 5/1984 | Rohrich et al. | 455/192.1 |
| 5,754,034 | 5/1998 | Ratliff et al. | 323/206 |
| 5,900,795 | 5/1999 | Holmgren et al. | 336/55 |
| 5,929,737 | 7/1999 | Zinders et al. | 336/155 |
| 5,936,503 | 8/1999 | Holmgren et al. | 336/60 |

FOREIGN PATENT DOCUMENTS

| | | |
|---|---|---|
| 510 932 | of 1971 | Switzerland . |
| WO 94/11891 | of 1994 | WIPO . |

OTHER PUBLICATIONS

Fisher et al., D.C. Controlled 100 MVA Reactor, , G.E.C. Journal, 1955, pp. 94–104.

Von Werner Krämer, Drehstromtransformator mit regelbarem Magnetisierungsstrom, ETZ Elektrotechnische Zeitschrift, 1959, vol. 80, No. 14, pp. 441–445.

*Primary Examiner*—Adolf Deneke Berhane

*Attorney, Agent, or Firm*—Pollock, Vande Sande & Amernick

[57] ABSTRACT

A controllable inductor comprises at least a tubular core, a main winding (1) surrounding the core and a control winding (3) passing substantially axially through the core. It is adapted for connection to a three phase alternating current network and has for this sake for each phase (14–16) a main winding (1) for connection to the phase, a core and a control winding, and the control windings of the three phases are electrically connected in series to each other.

10 Claims, 2 Drawing Sheets

CONTROLLABLE INDUCTOR

FIELD OF THE INVENTION

The present invention relates to a controllable inductor comprising at least a tubular core, a main winding surrounding the core and a control winding passing substantially axially through the core.

BACKGROUND OF THE INVENTION

Such controllable inductors may through the main winding thereof be connected to any electrical circuit, such as a power line, to provide the circuit with an inductance, for example for extinguishing higher harmonic currents generated in the circuit. The magnetic permeability of the core and thus the inductance of the inductor may then be controlled by changing the electric control current brought to flow axially through the core in the control winding. By connecting such a controllable inductor in series to a capacitor a so called harmonic filter may be obtained, which is already known through Applicants' for example, WO 94/11891 of the applicant, and in which the impedance may be controlled to be low for certain frequencies by controlling the inductance of the inductor for eliminating higher harmonic currents having a frequency being a multiple, for example 11, of the fundamental frequency of the network.

Another conceivable field of use for a controllable inductor of this type, in the case that such may deliver an inductance being sufficiently high, is the switching in thereof into alternating current power lines, having a high capacitance stored therein, for example cable networks. By an intercoupling of such an inductor an inductance of a desired size may then be connected thereto and the reactance of the power line may thus be reduced for a more efficient energy transfer through the line.

These controllable inductors have of course only a useful influence upon an alternating voltage, but it is not completely necessary that the main winding is connected to an alternating voltage. For example, it could also be connected to a direct voltage with an alternating voltage superimposed. A disadvantage of such controllable inductors already known is the fact that the alternating voltage in the main winding induces an alternating voltage in the control winding having a frequency being twice the fundamental frequency in the main winding. This voltage gives rise to harmonic currents in the network and causes losses in the core.

SUMMARY OF THE INVENTION

The object of the present invention is to provide a controllable inductor as defined in the introduction, in which the above problems have been solved to a large extent.

This object is according to the invention obtained by adapting such an inductor for connection to a three-phase alternating current network and it has for each phase, a main winding for connection to the phase, a core and a control winding. The control windings of the three phases are electrically connected in series with respect to each other.

Due to the provision of one controllable inductor with means including a main winding, a core and a control winding, for connection of a controllable inductance to all the three phases of an alternating current network and the control winding of the three phases being connected in series to each other, an inductor may be formed, in which the voltages induced through the alternating voltage in the respective phase of the respective control winding will cancel each other out, since the sum thereof in the control winding connected in series will be zero due to the displacement of the alternating voltages of the phases by 120 electrical grades with respect to each other. As a result, the problems deriving from voltages induced in the control winding are not created, and the control current in the control winding will not be influenced by the alternating current network and for example in the case of a direct current remain a direct current.

According to a preferred embodiment of the invention at least one of the cores has a second control winding passing substantially axially therethrough, the second control winding being separated from the first control winding connected in series. The second control winding is connected to a voltage source of its own for individually regulating the control current therein independent of the regulation of the control current in the control windings connected in series. This allows regulation of the magnetic permeability in all the three cores through a regulation of the control current in the control winding connected in series while avoiding an induction of alternating voltages in this control winding. At the same time it is possible to individually regulate of the permeability of the cores having a second control winding, but this regulation will then give rise to an induced voltage of this type in exactly that control winding with harmonic currents in the current of that phase and losses in the core as a consequence. Although these problems will be considerably lower than would be the case at an individual regulation of a core for each phase. It is of course aimed at achieving regulation through the main winding in common connected in series and only carry out a "fine regulation" through the second control winding, so that the problems of the induced voltages therein may be minimized. It may during certain periods be advantageous to refrain from sending any control current through the second control winding at all and have it only as an additional regulation possibility when suddenly extreme situations arise.

According to another preferred embodiment of the invention all three cores are provided with a second control winding and the voltage source is connected thereto for individual regulation. A possibility of individual regulation of the permeability of each separate core is obtained in this way, in addition to the regulation in common, and the consequences thereof are those mentioned above in the embodiment just discussed.

According to another preferred embodiment of the invention the number of turns of the first control winding led through the respective core is high with respect to the corresponding number of turns of the second control winding. The main controllability is thus provided by the control winding connected in series while a second control winding provides a small individual controllability within a restricted range, and the size of the voltage induced in the second winding, which is proportional to the number of turns as mentioned, is kept at a low level and will be a so called ripple voltage.

According to a further preferred embodiment of the invention the voltage source connected to the second control winding is a direct voltage source adapted to generate a direct current of a controllable intensity in the second control winding, while in another preferred embodiment of the invention the control winding connected in series is connected to the direct voltage source adapted to generate a direct current of a controllable intensity in the control winding. It is true that it is common to utilize a direct current as control current in controllable inductors of this type, which implies a simple regulation, but this may here be done while maintaining this direct current without any or only an unessential influence thereupon by the voltage of the alternating current network.

According to another preferred embodiment of the invention the inductor comprises at least one direct voltage source which is bipolar and means controllable to reverse the polarity of the voltage applied over the control winding through this direct voltage source. This solves the problem arising when using unipolar direct voltage sources, in which the control current increases much faster than it decreases. It will namely be possible to reverse the sign of the voltage upon a desire of a reduction of the control current and keep it so reversed until the control current has reached a desired level, in which substantially the same speed may be obtained for the reduction of the control current as for the increase thereof.

According to another preferred embodiment of the invention the inductor comprises a yoke of a material having a high magnetic permeability, which is in common to and closes the substantially axially main magnetic flux generated by the respective main winding through all cores and forms the main magnetic flux path between all cores. A very good controllability of the inductance of the controllable inductor within a wide range is obtained by this, since substantially all the energy stored thereby will be present in the controllable core legs, i.e. the material having a low magnetic permeability, at the same time as the magnetic flux passing through the respective core may be distributed on the other two cores, so that the sum of the magnetic flux is zero in each moment.

BRIEF DESCRIPTION OF THE DRAWINGS

With reference to the appended drawings, below follows a description of preferred embodiments of the invention cited as examples.

In the drawings.

DETAILED DESCRIPTION OF PREFERRED EMBODIMENTS OF THE INVENTION

Figure 1:
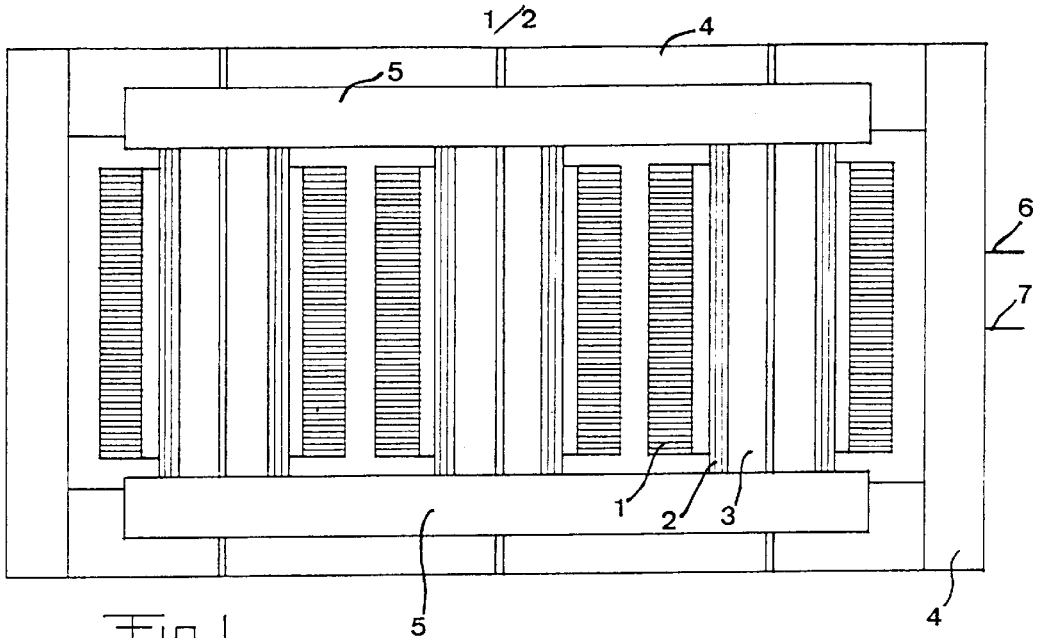
FIG. 1 is a simplified, partially sectioned side elevation of a controllable inductor according to a first preferred embodiment of the invention.

Schematically illustrated in FIG. 1 is an inductor according to the invention for connection to a three-phase alternating current network having control windings for each core connected in series may look. The inductor has a main winding 1, a core 2 arranged substantially coaxially thereto and a control winding 3 extending axially through the core for each phase (14, 16) of the three-phase network. Thus, each main winding 1 is connected to one of the phases alternating current network and has an upper end on high potential, the voltage falling in the direction towards the opposite end being the lower one in FIG. 1 which may be on ground potential, but that has not to be the case. The control windings 3 are connected in series to each other through parts 4 extending therebetween and schematically illustrated. The parts 4 and the parts of the control windings extending through the cores are made of plates of a material having a high electric conductivity, such as copper plates. A control winding in the form of such plates provides a stable mechanical construction and a good possibility to guide the control windings in desired paths. The different cores 2 are magnetically connected to each other through yokes 5 arranged at the respective core end and being of a material having a high magnetic permeability, which are in common to and close the substantially axially main magnetic flux generated by the respective main windings through all cores and form main magnetic flux paths between all the cores.

A direct voltage source for generating a direct current through the control windings connected in series is preferably connected by its terminals at 6 and 7, respectively, in FIG. 1. These connections being of course carried out to different layers of control winding plates being mutually isolated so that the current flows from one of these connections and then through all the control windings in the entire control winding connected in series and then back to the other of the connections. The control current in the control winding 3, 4 will generate a magnetic flux directed tangentially and transversely to the main magnetic flux generated by the main winding in the respective core and in this way reduce the permeability thereof of for the longitudinal magnetic flux of the main winding. Accordingly, by increasing the current in the control winding, the permeability of the core may be reduced and the inductance of the inductor reduced. This is the main principle according to which a controllable inductor of this type functions. Typical intensities of the control current and the voltage over the main winding are 100–500 A and 1–400 kV, respectively.

Figure 2:
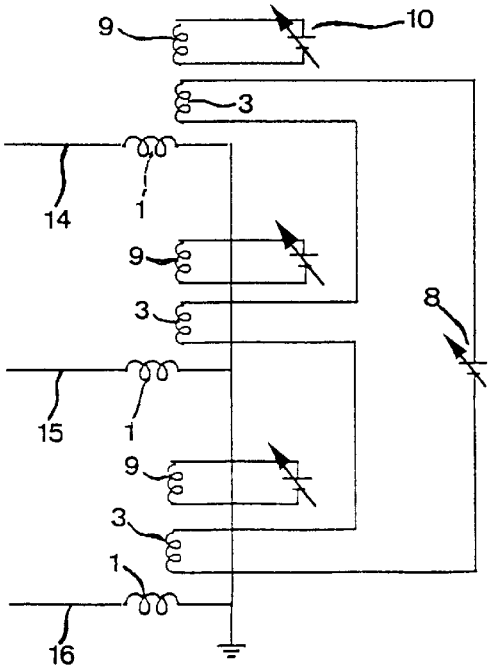
FIG. 2 is a simplified circuit diagram illustrating the control function of an inductor according to the preferred embodiment of the invention.
Figure 3:
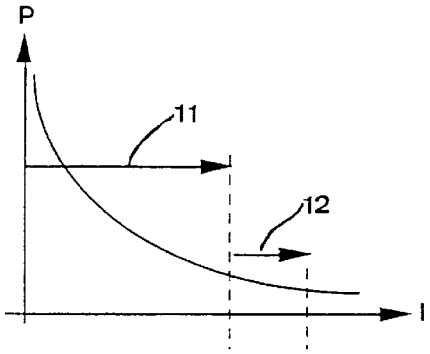
FIG. 3 is a diagram illustrating the connection between the control current and the permeability of a core in an inductor according to the invention for control in common and individual control thereof according to FIG. 2.

It is illustrated in FIG. 2 how the controllability of an inductor of the type shown in FIG. 1 may be realized according to a preferred embodiment of the invention. Here it is shown that the three control windings 3 of the respective core and by that for the respective phase main winding 1 are connected in series to each other and connected to a common controllable direct voltage source 8. All three phases, or more exactly the cores, are in addition thereto provided with a second control winding 9 passing substantially axially therethrough and which is separated from the first control winding connected in series. The second control windings are connected to a controllable direct voltage source 10 of its own for individual control of the control current therein independently of the control of the control current in the control windings connected in series. It is the magnetic permeability in the respective core that is regulated through varying the control current therethrough, and it is illustrated in FIG. 3 how the permeability P decreases with increasing control current I, wherein within a first larger area, which is indicated with the longer arrow 11, the permeability is intended to be regulated through varying the control current through the control winding connected in series, in which voltages induced by the voltage of the net work cancel each other out. An individual regulation of the permeability is intended to take place within a smaller area, which is indicated through the shorter arrow 12, and this individual regulation gives rise to such induced voltages in the respective second control winding. A considerably lower number of winding turns in the second control winding than in the first means low induced alternating voltages, so called ripple voltages, with a frequency being twice the fundamental frequency of the net work in the second control winding. The arrow 12 may actually be replaced by a double arrow directed in the opposite direction from the dashed line at the end of the arrow 11 for fast regulation of the permeability in the respective core through plus or minus influence through a second control winding. However, the second control winding would usually only be used for regulation in the direction of permeability reduction so as to not generate unnecessary heat losses in the control windings.

Figure 4:
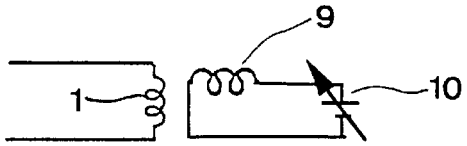
FIG. 4 is a simplified circuit diagram illustration a part of the control windings, namely the control winding for individual control of the permeability of a core, in a controllable inductor according to the invention.
Figure 5A:
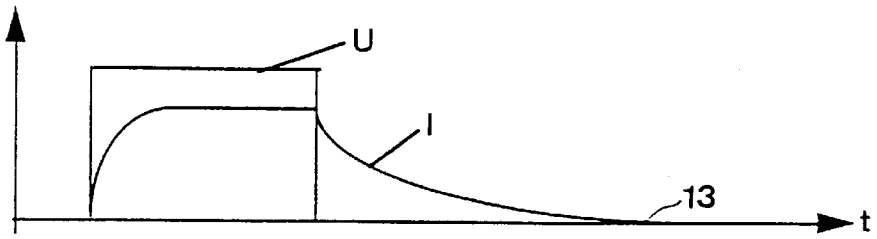
FIGS. 5*a* and 5*b* are two diagrams illustrating the development of the control current versus the control voltage applied over a control winding according to FIG. 4 when using a unipolar and a bipolar direct voltage source, respectively.

It is shown in FIG. 4 how a controllable direct voltage source 10 is connected to a control winding 9 for regulation of the permeability of a core in a controllable inductor of the type discussed above. It is further illustrated in FIG. 5*a* how the control current I is changing over time t depending upon the voltage U connected over the control winding through the direct voltage source 10, in the case of a unipolar direct voltage source. It appears that an increase of the control current will be much faster than a decrease, so that the adaptability to a desired control current level 13 will be inferior when it is desired to reduce the control current prevailing than when this is to be increased.

Figure 5B:
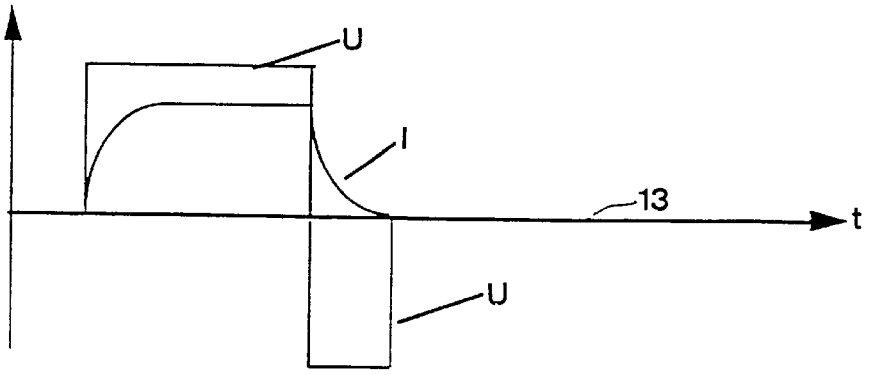

However, it is illustrated in FIG. 5*b* happens in the case of a bipolar direct voltage source 10 as in a preferred embodiment of the invention, so that the sign of the voltage applied over the control winding may be reversed when desired. It appears from this diagram that a reverse of the voltage over the control winding until the control current has been reduced to a desired level 13 results in a regulation speed for the control current being just as high upwardly as downwardly. Such a bipolar direct voltage source may be connected to the second control windings 9 and/or to the first control windings 3 connected in series.

The invention is of course not in any way restricted to the preferred embodiments described above, but many possibilities to modifications thereof would be apparent to a man skilled in the art without departing from the basic idea of the invention.

What is claimed is:

1. Controllable inductor for connection to a three-phase alternating current network, comprising:

a tubular core for each one of the phases;

a main winding for each core for connection to its respective phase, the main winding surrounding the core;

a control winding for each core passing substantially axially through the core, the control windings of the phases being electrically connected in series with each other.

2. An inductor according to claim 1, wherein at least one of the cores has a second control winding passing substantially axially therethrough, the second control winding being separated from the control winding for the core, the second control winding is connected to a voltage source for individually regulating a control current therein, independently of the regulation of a control current in the control windings connected in series.

3. An inductor according to claim 2, wherein all the cores are provided with a second control windings and separate voltage sources connected thereto for individual regulation of each.

4. An inductor according to claim 2, wherein a number of turns of the control winding connected in series brought through its respective core is great with respect to a corresponding number of turns of the second control winding.

5. An inductor according to claim 2, wherein the voltage source connected to the second control winding is a direct voltage source adapted to generate a direct current of an adjustable intensity in the second control winding.

6. An inductor according to claim 1, wherein the control windings connected in series are connected to a second direct voltage source adapted to generate a direct current of adjustable intensity in the control windings.

7. An inductor according to claim 5, wherein the direct voltage source is bipolar and the inductor further comprises means controllable to reverse the sign of the voltage applied over the control winding through said direct voltage source.

8. An inductor according to claim 6, wherein the second direct voltage source is bipolar and the inductor further comprises means to reverse the sign of the voltage applied over the control winding through said direct voltage source.

9. An inductor according to claim 1, further comprising a yoke of a material having a high magnetic permeability, the yoke being in common to and closing a substantially axial main magnetic flux generated by the respective main windings through all cores and forming the main magnetic flux path between all cores.

10. An inductor according to claim 1, wherein at least the control winding connected in series is formed by plates of a material having a good electric conductivity.

* * * * *